US006629766B2

(12) United States Patent
Cathel

(10) Patent No.: US 6,629,766 B2
(45) **Date of Patent: *Oct. 7, 2003**

(54) ILLUMINATING ADDRESS INDICATION DEVICE

(76) Inventor: Wayne Cathel, 806 Ponce de Leon Blvd., Belleair, FL (US) 33756

( * ) Notice: Subject to any disclaimer, the term of this patent is extended or adjusted under 35 U.S.C. 154(b) by 0 days.

This patent is subject to a terminal disclaimer.

(21) Appl. No.: 10/267,372

(22) Filed: Oct. 9, 2002

(65) Prior Publication Data

US 2003/0053308 A1 Mar. 20, 2003

Related U.S. Application Data

(63) Continuation-in-part of application No. 09/539,050, filed on Mar. 30, 2001, now Pat. No. 6,299,325.

(51) Int. Cl.[7] ..... F21L 13/00

(52) U.S. Cl. ..... 362/183; 362/29; 362/154; 362/368; 40/553; 40/566

(58) Field of Search ..... 362/29, 154, 183, 362/368, 23, 30, 157, 362, 363, 367, 800; 40/553, 560, 541, 542, 500, 550, 564; 232/16

(56) References Cited

U.S. PATENT DOCUMENTS

| | | | | | |
|---|---|---|---|---|---|
| 1,781,282 | A | * | 11/1930 | Hulett | 40/566 |
| 1,789,239 | A | * | 1/1931 | Landgraf | 40/566 |
| 1,842,597 | A | | 1/1932 | Foti | |
| 1,979,727 | A | | 11/1934 | Bennett et al. | |
| 2,452,667 | A | | 11/1948 | Lambert | |
| 4,384,317 | A | | 5/1983 | Stackpole | |
| 4,611,265 | A | * | 9/1986 | Davis | 362/145 |
| 5,101,329 | A | * | 3/1992 | Doyle | 362/183 |
| 5,143,285 | A | | 9/1992 | Wise | |
| 5,303,124 | A | | 4/1994 | Wrobel | |
| 5,460,325 | A | | 10/1995 | Surman | |
| 5,522,540 | A | * | 6/1996 | Surman | 232/17 |
| 5,635,902 | A | | 6/1997 | Hochstein | |
| 5,649,378 | A | | 7/1997 | Roesser, Jr. et al. | |
| 5,832,642 | A | | 11/1998 | Dalton | |
| 5,850,126 | A | | 12/1998 | Kanbar | |
| 5,897,194 | A | | 4/1999 | Ham | |
| 6,299,325 | B1 | * | 10/2001 | Cathel | 362/183 |

* cited by examiner

*Primary Examiner*—Alan Cariaso
*Assistant Examiner*—Ismael Negron
(74) *Attorney, Agent, or Firm*—Larson & Larson, PA; James E. Larson

(57) ABSTRACT

An illuminating mailbox address indication device includes a generally rectangular shaped housing mounted on a top portion of a mailbox wherein at least one longitudinal wall is removable. Enclosed within the housing is a light means powered by at least one rechargeable battery energized by a solar cell mounted upon the housing top wall in a recess formed therein. A photosensitive cell operates a switch to permit the light means to illuminate when a pre-determined threshold has been exceeded relevant to the amount of ambient light present around the mailbox (i.e., at night). At least one of the longitudinal housing side walls is translucent and further supports indica stenciled thereupon which represents the address of the property associated with the mailbox.

25 Claims, 11 Drawing Sheets

ILLUMINATING ADDRESS INDICATION DEVICE

PRIOR APPLICATIONS

This application is a continuation-in-part application of Ser. No. 09/539,050, filed Mar. 30, 2001, which issued on Oct. 9, 2001 as U.S. Pat. No. 6,299,325.

BACKGROUND OF THE INVENTION

1. Field of the Invention

This invention relates to property address indication. More particularly, it relates to a device for mounting upon the top of a mailbox which is capable of illuminating the address of the property associated with the mailbox so it can be seen in the absence of light.

2. Description of Prior Art

Mailboxes are well known in the prior art and are the most commonly used devices for delivery of mail by the U.S. Postal Service. Typically, a mailbox associated with a particular home or business is located along the edge of the property on which the home or business is situated. The mailbox may have the address of the property, in the form of indica, stenciled upon the mailbox which assists the mail delivery person in identifying the address of the home or business. Typically, mail is delivered by the U.S. Postal Service during daylight hours, therefore there is no need to illuminate the address indicia. However, the indicia also acts to guide others who may be attempting to locate a particular home or business. For instance, if a certain individual lives at 125 Main Street, a person trying to locate this property may look at the numbers stenciled on the mailbox until number 125 is recognized while driving on Main Street thereby indicating that the desired property has been located.

At night however, this may be more difficult. It can be very difficult to legibly read the address numbers on mailboxes due to the absence of light. Even on well lit streets, it can be difficult to read the indicia stenciled on the mailbox. If the individual is driving a motorized vehicle and there is other motorized vehicles behind the lead vehicle, it quickly becomes dangerous to repeatedly slow down and speed while attempting to locate the home or business.

Of course, many homes are well lit and specifically shine light upon indicia which may be stenciled directly to the house or business. This certainly can assist in identifying the address of a particular property. However, in rural areas, many homes, for instance, are situated far from the entrance of the driveway. Typically though, the mailbox remains mounted proximal to the entrance of the driveway. Accordingly, the same problem persists as described above. In low light settings, individuals will find it difficult to locate the home or business that they seek due to not be able to read the indicia which identifies the particular home or business.

Some have attempted to alleviate this dilemma by mounting indicia on a small illuminated box. These devices are typically staked into the ground near the entrance of the property. Unfortunately, such a device has inherent deficiencies. First and foremost, most people are not looking at the ground of the property but the mailbox or building itself in an attempt to locate a specific property. Accordingly, many people merely overlook the small staked device. Further, such a device can be easily removed and therefore stolen or removed by vandals. Further, where two or more properties are closely located, someone searching for a particular home or business may become confused as to which property the small box is associated.

What is needed is a device which can overcome all of the deficiencies in the prior art. Such a device should be illuminated so that it can visually broadcast the property address indicia at night. Further, the device should be mounted to the mailbox so that people can easily find the location of the property they seek. Since the device does not need to illuminate the indicia during daylight hours, it should include a means for shutting off during daylight hours and thereafter illuminate during nighttime hours. The device would also excel over prior art devices if it is mounted directly to the mailbox to avoid be stolen. But at the same time, the device should be easy to install so that it can be retrofit to existing mailboxes already employed. Since batteries quickly discharge, it would also be advantageous to utilize rechargeable batteries. And, since daylight hours are present in most areas of the world at least some portion of the day, it would be advantageous to utilize a solar cell for recharging the batteries thereby eliminating the need for an external charging source. The device should also include a light means which is inexpensive and uses a minimal amount of power. Finally, the light means should be enclosed within a housing which permits light to diffuse outwardly from within while permitting indicia to be stenciled thereupon.

SUMMARY OF THE INVENTION

I have invented an improved property address indication device which overcomes all of the deficiencies seen in the prior art. My device includes a housing and a base member. The device mounts to the rounded apex portion of a traditionally-shaped, generally rectangular mailbox. My device permits illumination at night of indicia stenciled to the device housing, representing the address of the property. A light, such as an LED, is employed to illuminate an inner channel of the device which can be activated in the absence of ambient light. A rechargeable battery powers the light and solar cell, mounted to the device housing, recharges the battery.

In particular, my device includes a housing having a central channel formed under a pair of longitudinally disposed side walls, a top wall and a pair of opposed end walls. In the preferred embodiment, at least one longitudinal side wall is removable, however, nothing herein limits that both side walls could not be removable. Bottom edges along each longitudinal side wall rest upon outwardly extending shelf portions of the base member. A reflective film can be added to a top surface of the base member which is then in turn enclosed within the housing inner channel to assist in dispersing the light given off by the light source.

A photosensitive cell mounted proximal to the solar cell acts as a switch to turn the light on and off based on the ambient light present around the device. Indicia mounted along one or both longitudinal side walls of the housing is illuminated by the light source means.

A set of locking tabs mounted downwardly along an inner surface of a top wall of the housing along with a set of vertical guide rails positioned near four inner corners of the housing assist in receiving and retaining the longitudinal side walls in place. Further, the longitudinal side walls include small outwardly projecting shoulder portions disposed along an outer bottom edge of the side walls which rest within retention slots of the guide rails.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
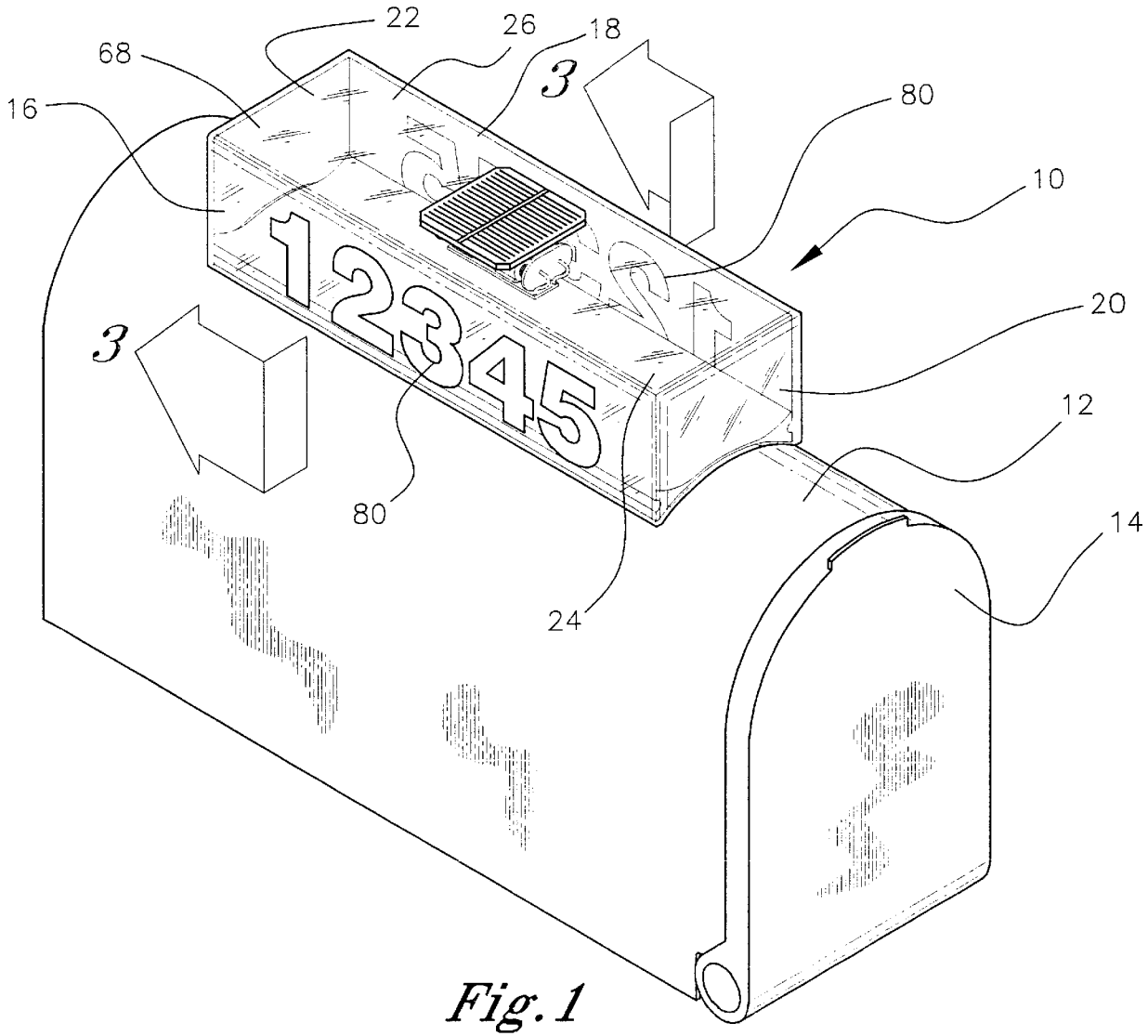
FIG. 1 is a perspective view of an embodiment of an illuminated mailbox address device of the present invention.

Throughout the following detailed description, the same reference numerals refer to the same elements in all figures.

Figure 3:
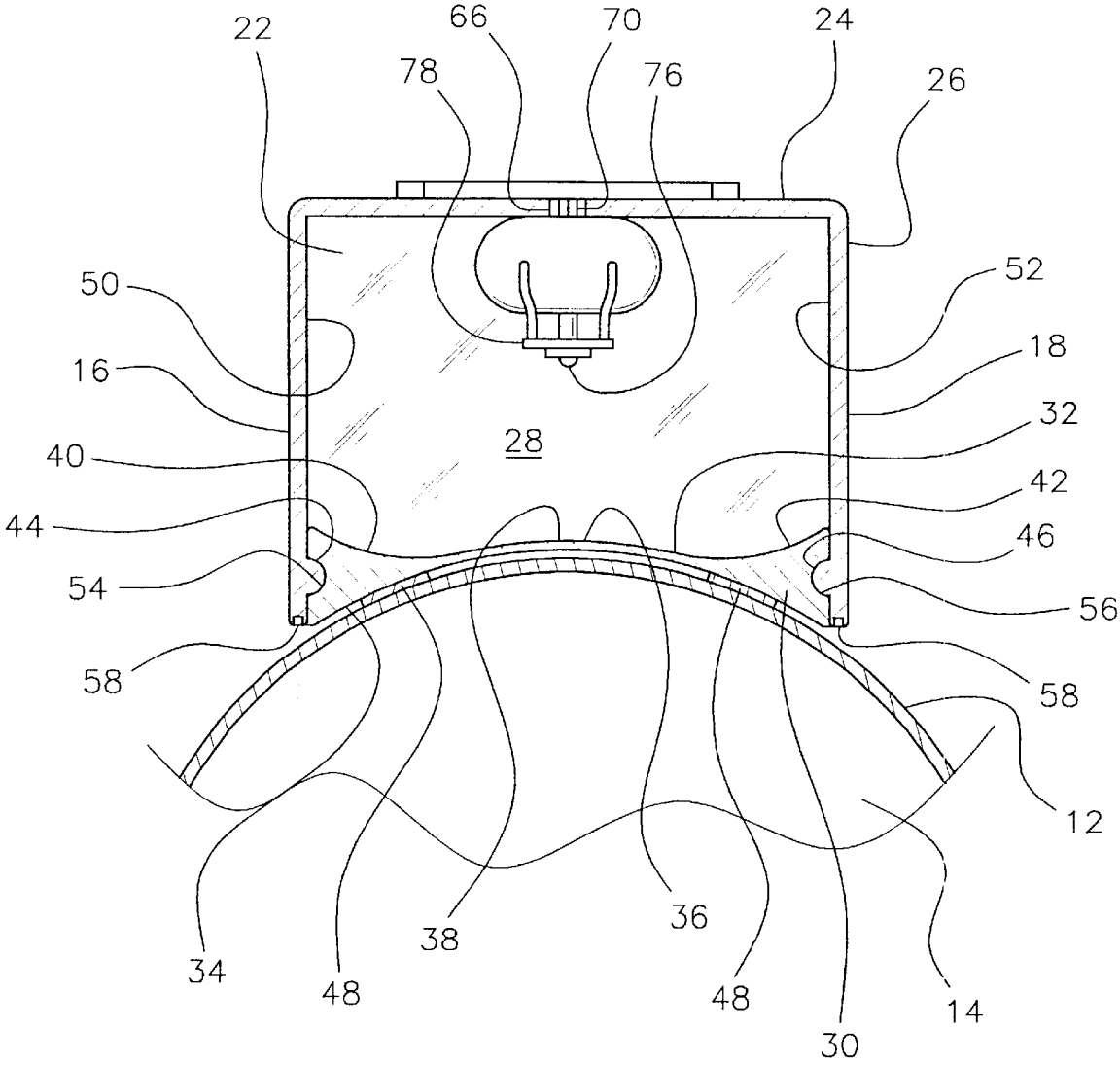
FIG. 3 is a front view, partially in section, of the invention shown in FIG. 1.

Referring to FIG. 1, a first embodiment of an illuminated mailbox address device 10 is shown mounted on a top portion 12 of a traditionally-shaped, generally rectangular mailbox 14. Top portion 12 of mailbox 14 is convexed-shaped. Address device 10 includes a housing 26 having a pair of longitudinally disposed side walls 16 and 18, a front and back wall, 20 and 22, and a top wall 24. As shown in FIG. 3, housing 26 and its associated walls form a channel 28.

Figure 2:
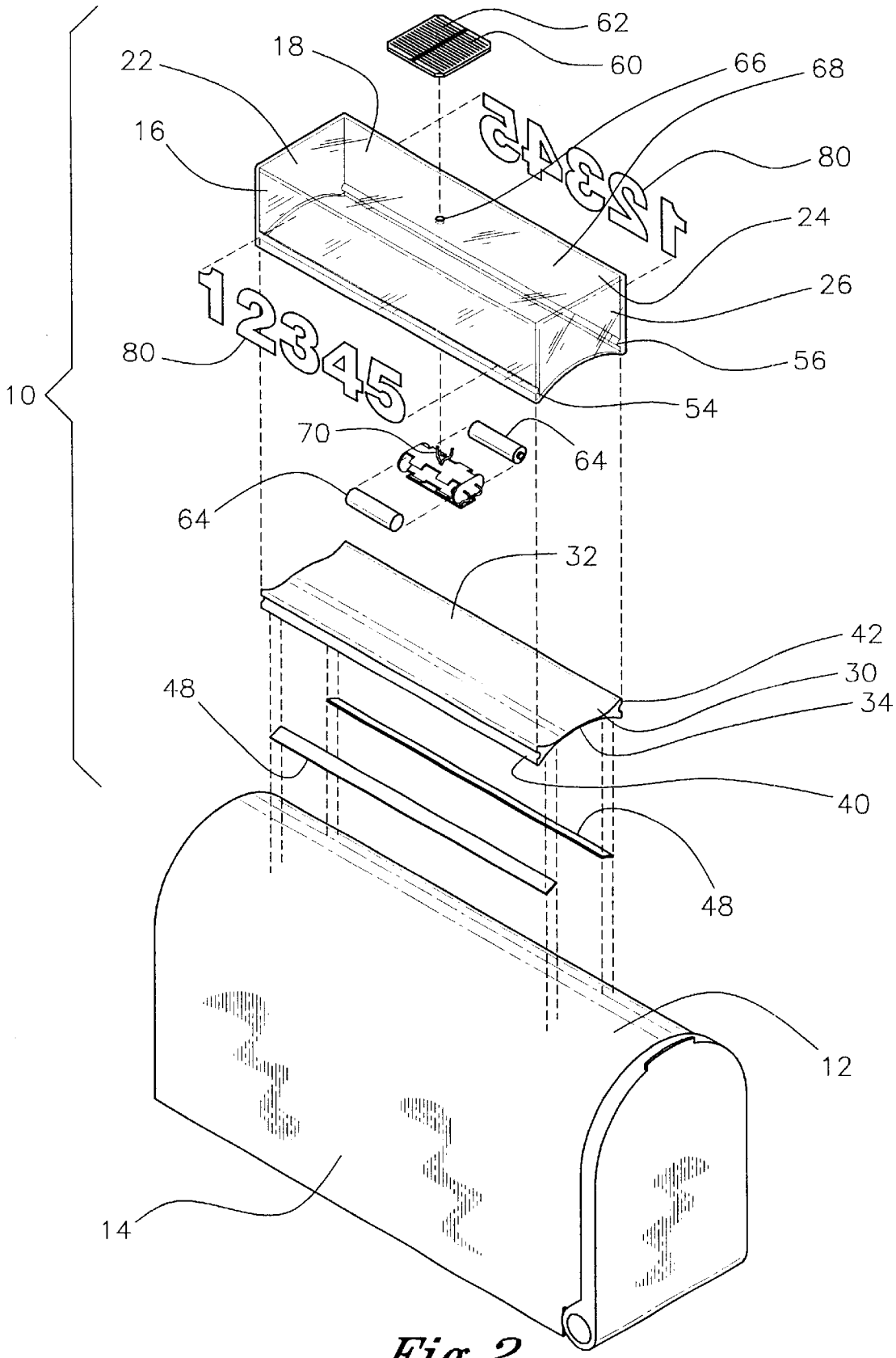
FIG. 2 is an exploded perspective view of the invention shown in FIG. 1.
Figure 4:
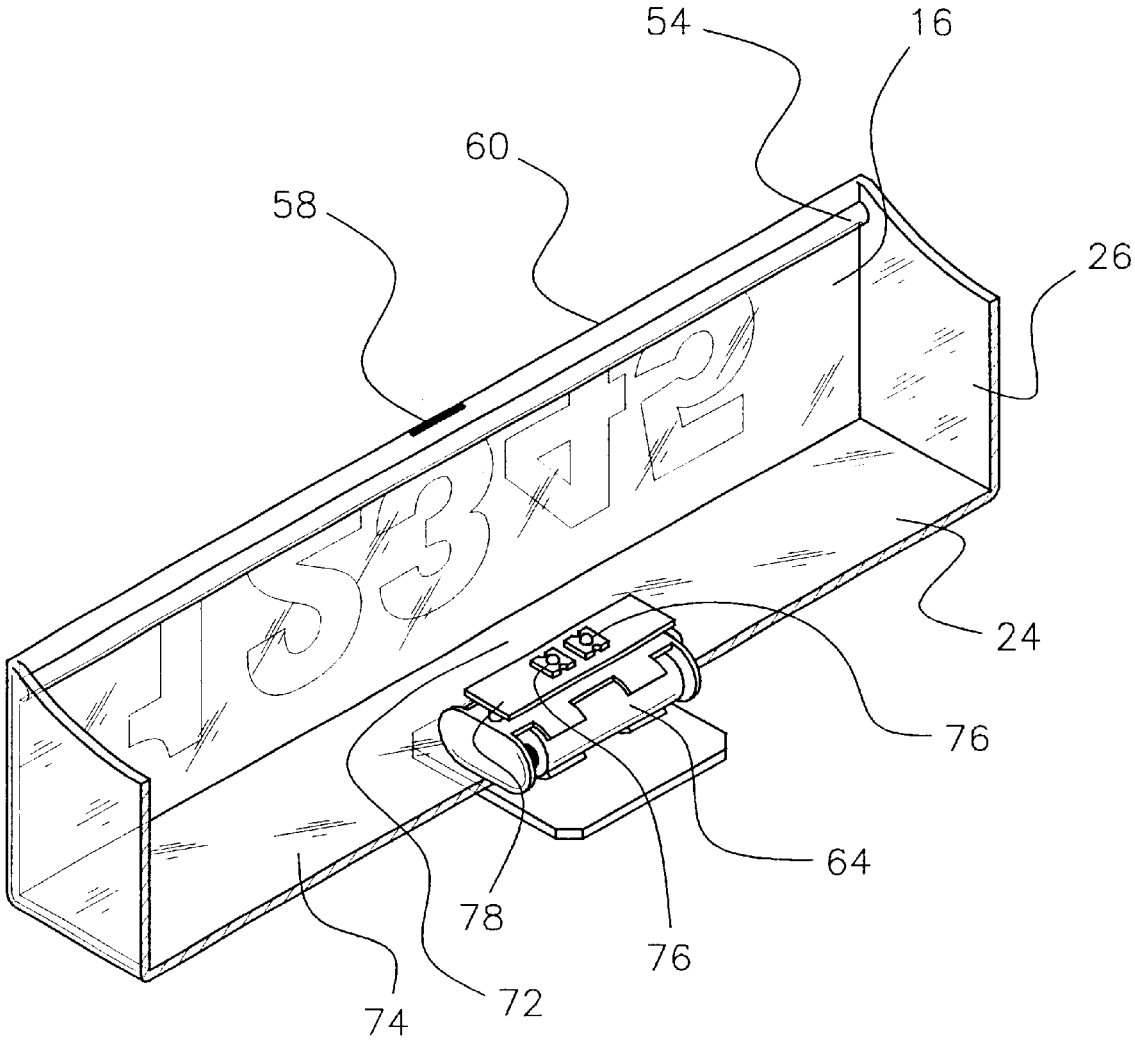
FIG. 4 is a bottom view, partially in section, of a housing used with the invention of FIG. 1 depicting the use of a single light source.

Referring to FIG. 2, an exploded view of address device 10 is shown depicting the various elements of the invention. Besides those described hereinabove, address device 10 further includes a base member 30 which engages housing 26. Base member 30 has a top and bottom surface 32 and 34 respectively. Base member bottom surface 34 is convexed-shape and mates with mailbox top portion 12 (see also FIG. 3) which, as previously described, is concave-shaped. Base member top surface 32 is generally convexed-shaped, except that a slight wave portion 36 is formed at a middle section 38 thereof. As shown in FIG. 3, base member 30 also includes opposed outwardly flanging side portions 40 and 42, each having a groove 44 and 46 formed along the longitudinal axis of each side portion 40 and 42. Along inner surfaces 50 and 52, respectively, of side walls 16 and 18 are a pair of semi-circular protruding ridges 54 and 56, respectively, longitudinally extending along the entire length of the each side wall 16 and 18. Semi-circular protruding ridges 54 and 56 mate with grooves 44 and 46 and ensure that housing 26 mates, by friction fit, to base member 30. As shown in FIG. 4, a small indention 58 is formed along a bottom edge 60 of at least one of the side walls, 16 or 18, permitting someone to insert a flat blade device (i.e., flat blade screw driver) and apply a small amount of pressure to "pop" housing 26 off from base member 30.

Referring once again to FIG. 2, it is shown that base member 30 attaches to mailbox top portion 12 by means of a pair of strips of double-sided tape 48. However, alternate means of attachment can be used, including, but not limited to, glue and screws. Address device 10 further includes a solar cell 60 (also known as a photovoltaic cell) and a photosensitive cell 62 mounted on a top surface 68 of housing top wall 24. Solar cell 60 collects energy from the sun during the daylight hours and energizes (recharges) a battery 64 mounted within housing 26. Photosensitive cell 62 acts as a switch to permit battery 64 to power a light means used with device 10. A small aperture 66 formed in housing top wall 24 permits a wire 70 to pass there through and electrically couple cells 60 and 62 to battery 64.

With continuing reference to FIG. 2, this first embodiment employs a pair of rechargeable batteries 64. Each battery is charged during the daylight hours by solar cell 60 collecting energy from the sun. As daylight diminishes, photosensitive cell 62, having a set threshold, reacts as a switch to permit energy to pass from batteries 64 to the light means thereby illuminating device 10.

As shown in FIG. 4, a single set of batteries 64 are used in this first embodiment and are mounted along a central portion 72 of a bottom surface 74 of housing top wall 24. Further to this first embodiment, a pair of LEDs 76 are employed for the light means, although any sort of illuminating bulb could be used. LEDs 76 mount to a small circuit board 78 which is electrically coupled to batteries 64.

Figure 5:
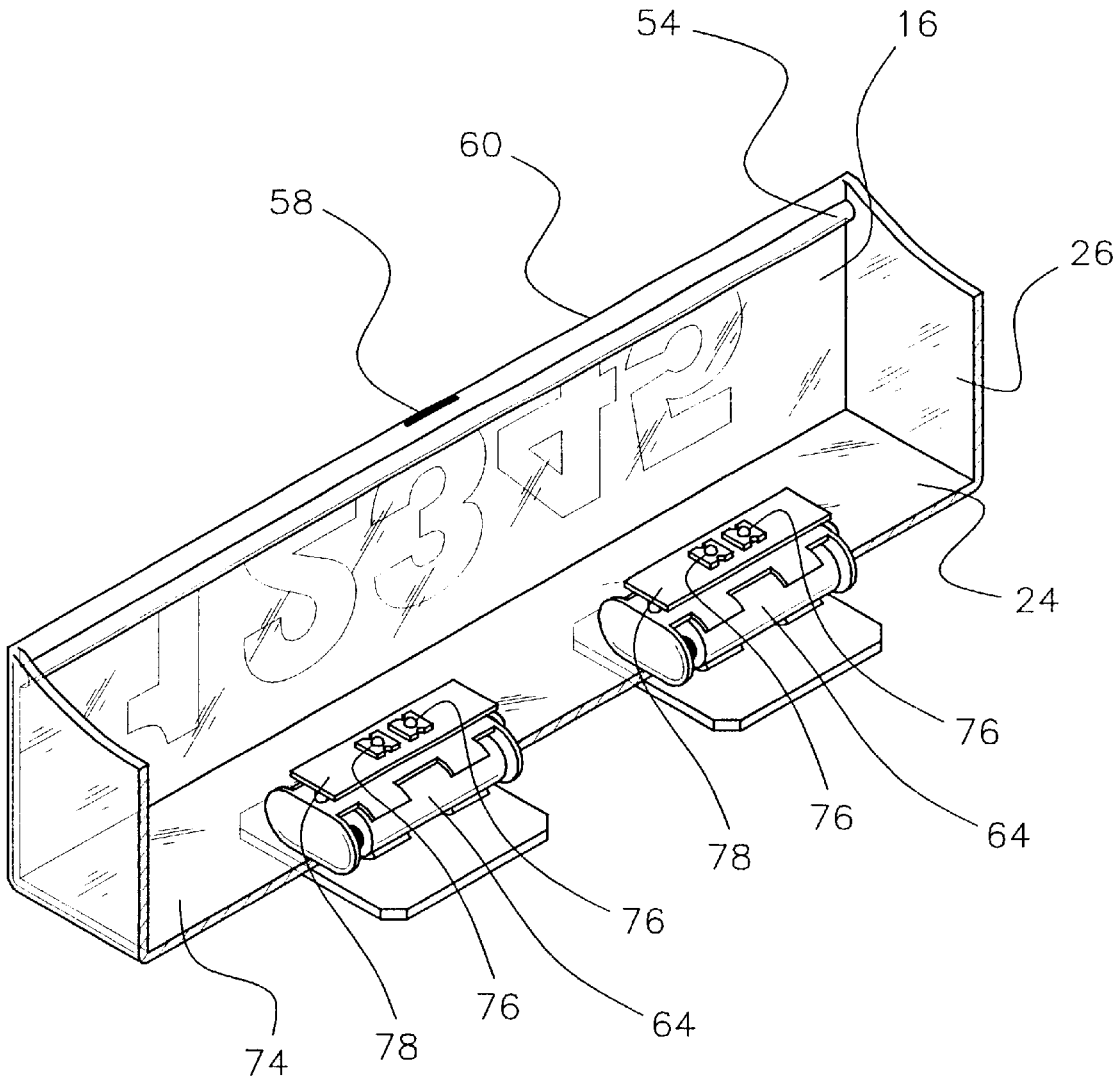
FIG. 5 is a bottom view, partially in section, of a housing used with the invention of FIG. 1 depicting the use of a pair of light sources spaced from another.

Referring to FIG. 5, a second embodiment of the present in is shown wherein a pair of batteries 64 and a pair of LED pairs 76 are employed along bottom surface 74 of housing top wall 24. In this second embodiment, batteries 64 and LEDs 76 are evenly spaced form one another to enhance the dispersion of light. Still further, other alternate embodiments, although not shown herein, utilize dispersion brackets mounted around the light means to enhance the light dispersion.

As shown in FIGS. 1 and 2, indicia 80 are mounted on device 10. In the first embodiment, indica 80 are mounted along side walls 16 and 18. Housing 26 is slightly opaque but permits ample light to permeate there through, thereby illuminating indicia 80. In this first embodiment, black letter indicia are employed, although nothing herein limits the use of other colored indicia.

In this first embodiment, housing 26 and base member 30 are made from a polymer, including but not limited to, polyethylene, polypropylene, polyurethane and polyvinyl chloride. Base member top surface 32 can further include a highly reflective material to assist in dispersing the light generated by the light means. Such material could include a reflective sheet of material glued to base member top surface 32.

Figure 6:
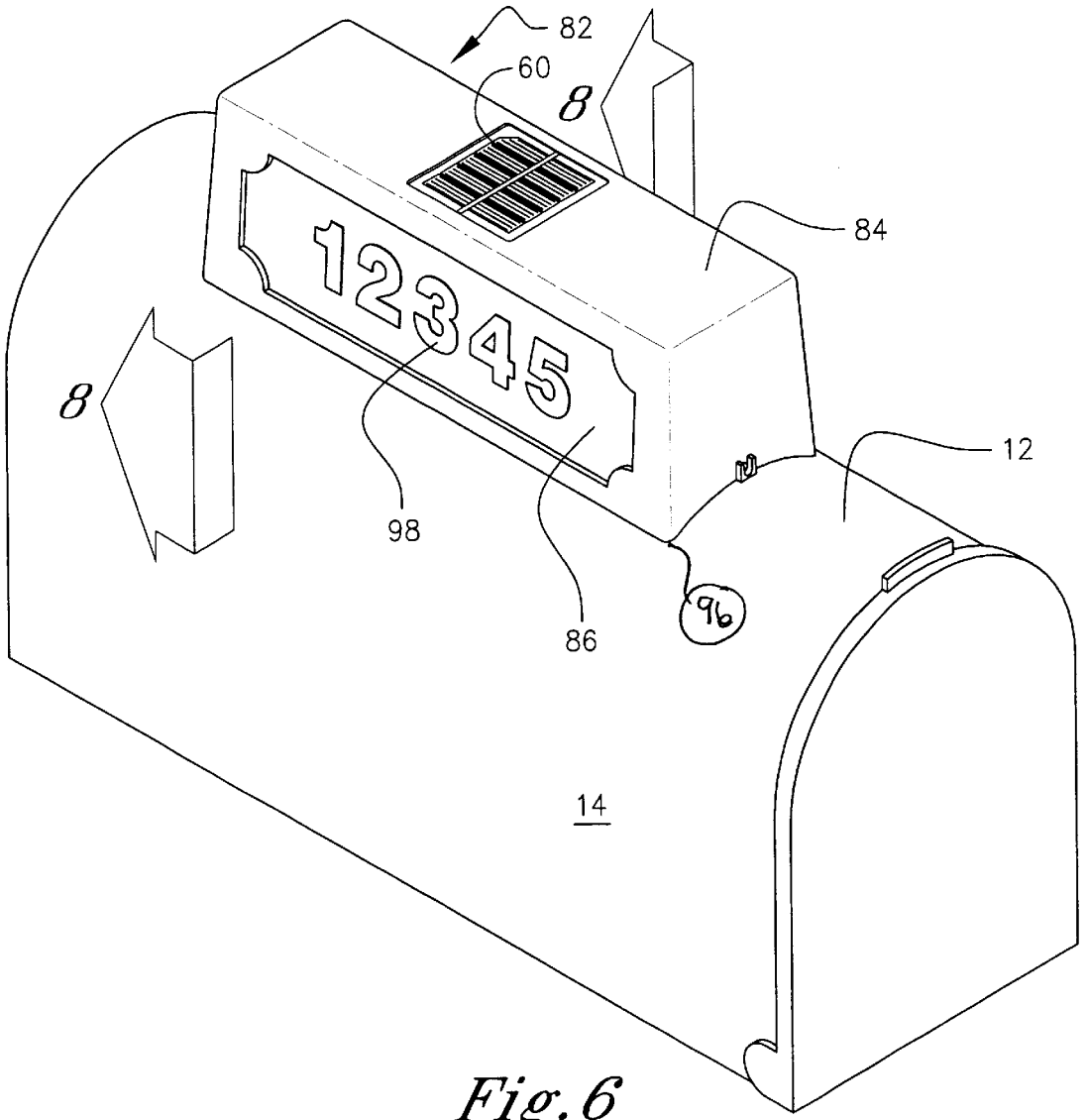
FIG. 6 is a perspective view of a preferred embodiment of an illuminated mailbox address device of the present invention.
Figure 7:
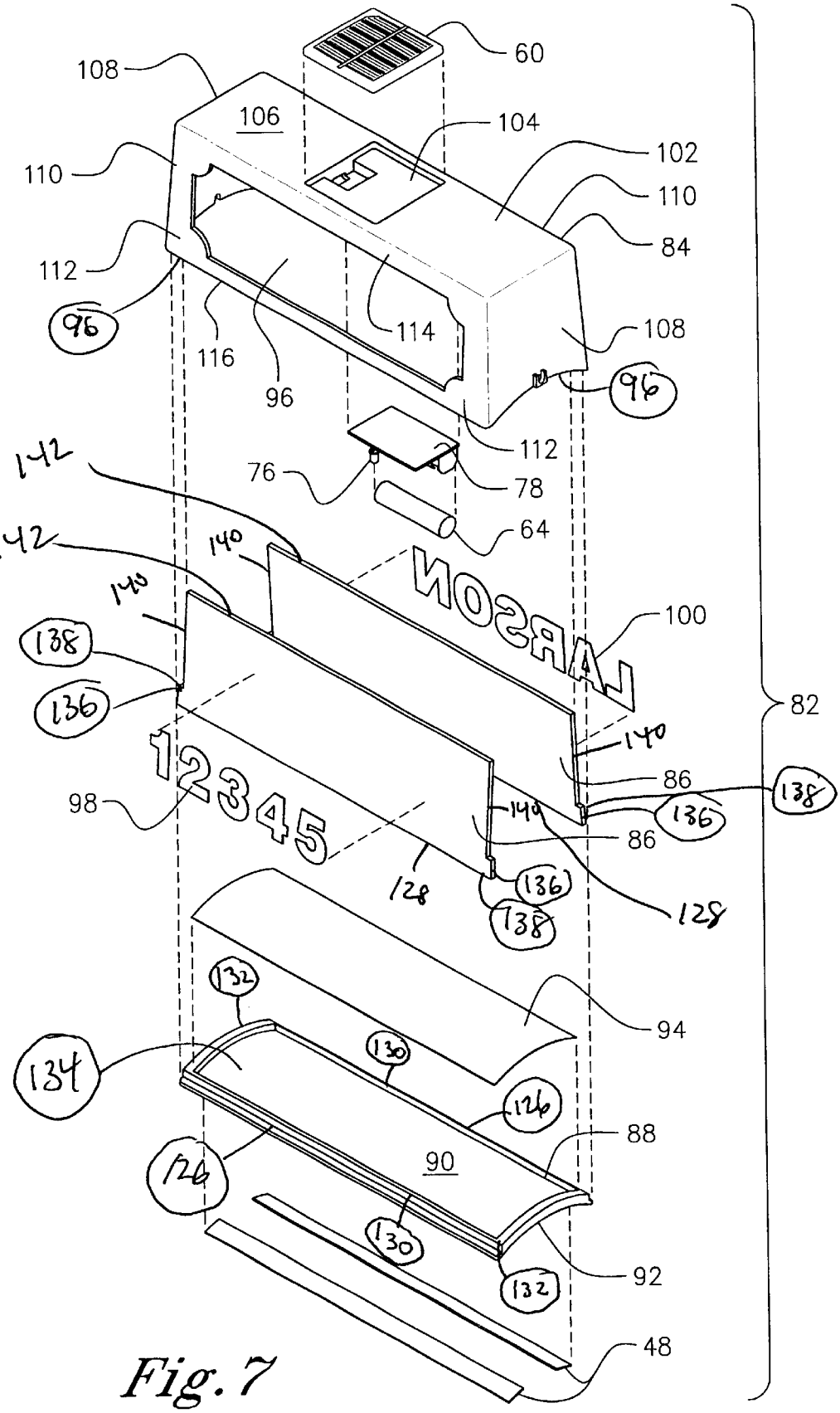
FIG. 7 is an exploded perspective view of the preferred embodiment of the invention shown in FIG. 6.

Referring to FIG. 6, the preferred embodiment of the present invention is shown wherein an illumination address indication device 82 is mounted along a top portion 12 of a mailbox 14. Referring to FIG. 7, it s shown that preferred illumination address indication device 82 includes a housing 84, pair of removable longitudinal side walls 86, a base member 88 having a convex-shaped top surface 90 and a concave-shaped bottom surface 92. Referring back to FIG. 6, it is shown that the concave-shaped bottom surface 92 of base member 88 is accommodated by the reciprocal convex shape of the mailbox top portion 12.

With continuing reference to FIG. 7, it is shown that strips of double sided tape 48 can be used to affix base member 88, and therefore device 82, to a mailbox 14 (see FIG. 6). Of course, as mentioned before, other manners of attachment could be employed. Further, more than two strips of tape 48 can be employed although FIG. 7 merely shows two strips. A reflective film 94 can be employed along base member top surface 90 to assist in the reflection of light emitted within housing 84 when it is enclosed, installed and activated.

Further, it is shown, by referring to FIG. 7, that preferred device 82 is constructed differently than that of first embodiment device 10, discussed directly hereinabove. In particular, depending on whether the user wishes to employ one or two removable longitudinal side walls 86, housing 84 is provided with an open area 96 on at least one of the longitudinal sides of housing 84 which is evident when side walls 86 are actually removed as clearly illustrated in FIG. 7.

In the preferred embodiment, housing 84 is an integrally formed piece and employs two removable longitudinal side walls 86. The removable longitudinal side walls 86 present some major differences over that which is described above in the first (alternate) embodiment. It is of course understood that housing 84 does not need to be an integrally formed piece; in fact it could be made from a multitude of pieces attached together in a plurality of different manners. However, at the time of the invention, use of the integrally formed housing 84 with a pair of removable longitudinal side walls 86 was contemplated as the best mode.

With continuing reference to FIG. 7, it is shown that housing 84 is non-translucent. However, nothing herein limits the use of a translucent housing, it is merely contemplated that at the time of invention the best mode was to use a non-translucent, non-transparent housing. On the other hand, it is very advantageous for removable side walls 86 to be translucent, since, as shown in FIG. 7, side walls 86 are primarily used for stenciling property addresses 98 and/or surnames 100 for recognition by those searching for a particular property, especially during the dark nighttime hours. Although the preferred embodiment employs a pair of translucent and removable longitudinal side walls 86, nothing herein limits the use of merely one translucent removable side wall 86.

Figure 8:
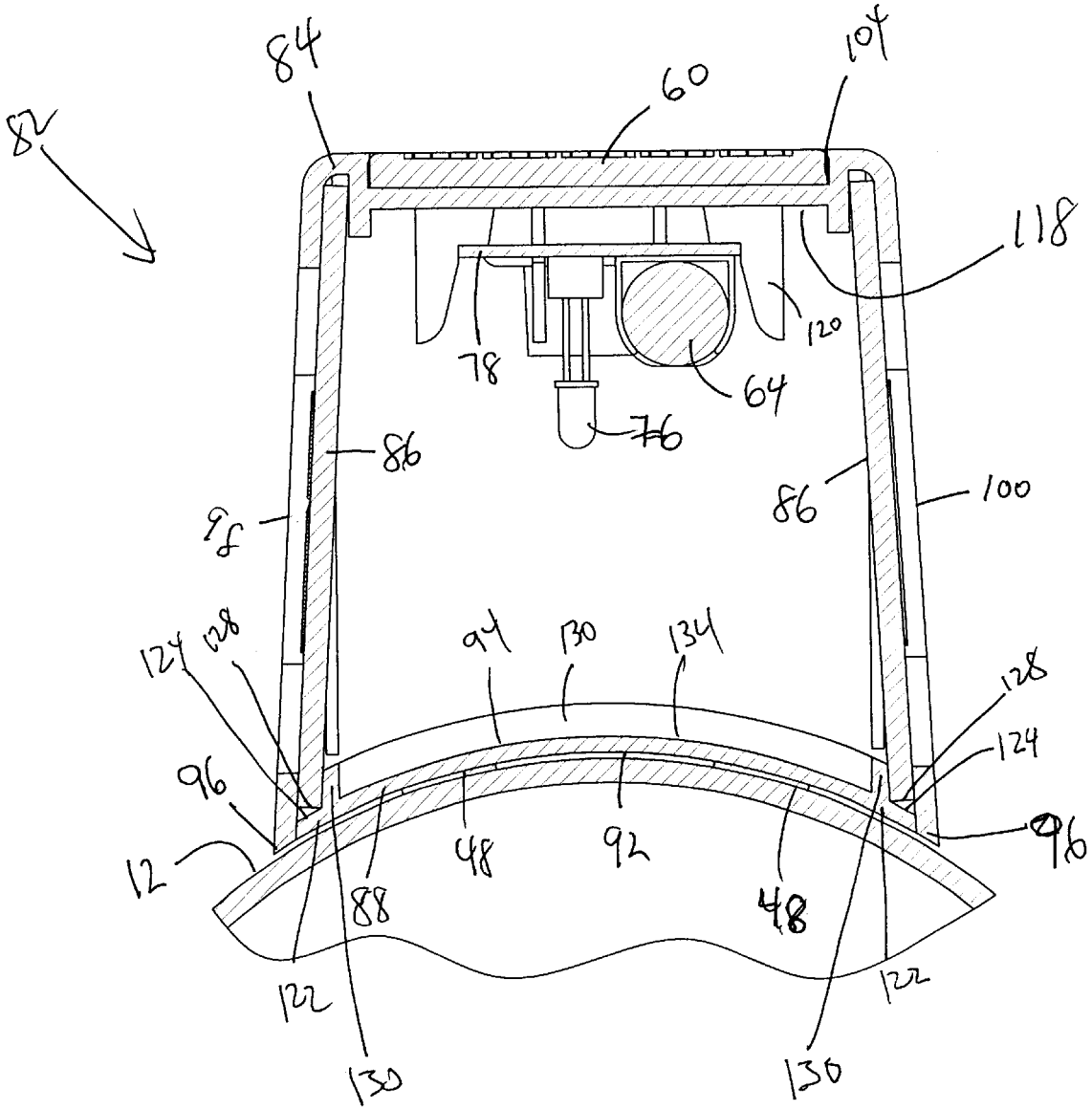
FIG. 8 is a cross-sectional view along lines 8—8 of FIG. 6.
Figure 9:
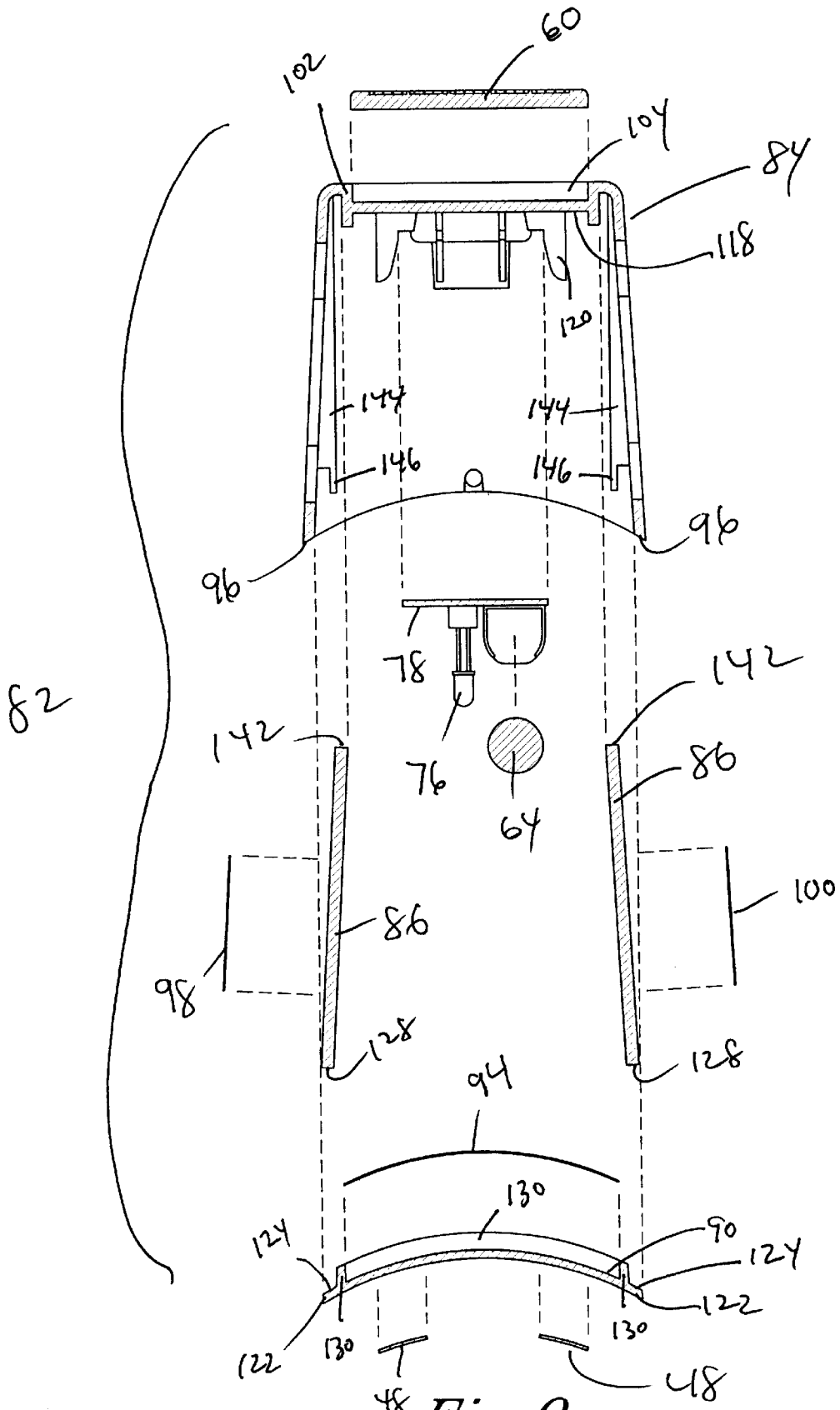
FIG. 9 is an exploded cross sectional view of the preferred embodiment of the invention shown in FIG. 8.

With continuing reference to FIG. 7, it is shown that preferred device 84 includes a solar cell 60 which is mounted along a top wall 102 of housing 84 within a recess 104 formed along a top surface 106 in housing top wall 102. Further, at least one battery 64 is employed, preferably a rechargeable battery, and is mounted proximal to a light source 76, such as an LED. As shown, both battery 64 and light source 76 are mounted onto a circuit board 78 which in turn is mounted within housing 84. Battery 64 is electrically coupled to solar cell 60 so that battery 64 can be recharged during the daylight hours by the sun for use by device 82 at nighttime. As shown in FIG. 8, circuit board 78 is mounted along an inner bottom surface 118 of top wall 102, although it could be mounted in other places as well. It is also understood, that depending on the size of housing 84, and therefore the size of device 82, more than one battery 64 could be employed along with more than one light source 76. Along those same lines, although not shown, more than one solar cell 60 could be employed depending on the size and battery requirements of device 82.

In the preferred embodiment, as previously stated, housing 84 is constructed as an integral unit as depicted in FIG. 7. However, nothing herein requires that housing 84 be integrally formed. The preferred integrally formed housing 84 includes top wall 102, opposed end walls 108 and opposed longitudinal side portions 110 which includes opposed end frame portions 112 which are connected by top and bottom connecting members, 114 and 116 respectively.

With reference now to FIG. 8, a cross-sectional view along lines 8—8 of FIG. 6, it can be seen that housing 84 is attached to base member 88 along a bottom side 96 of housing 84. It is also shown how the two strips of double sided tape 48 affix the base member bottom surface 92 to the mailbox top portion 12. As shown in FIG. 8, a retention frame 120 is employed along top wall inner bottom surface 118 to hold circuit board 78 in place. Base member 88 has a pair of outwardly extending side portions 122 forming a pair of shelves 124 which extend along a longitudinal edge 126 of base member 88 (see also FIG. 7). Shelves 124 permit a bottom edge 128 of longitudinal side wall 86 to rest thereupon when base member 88 snaps into housing bottom side 96. As shown in FIG. 7, base member 88 also includes upwardly extending wall portions 130 which are disposed proximal to and along an entire outer edge 132 of base member top surface 90. However, as shown in FIG. 8, upwardly extending wall portions 130 are positioned slightly inward from an absolute outer edge of base member top surface 90 which permits the formation of outwardly extending side portions 122 and shelves 124. As shown in both FIG. 7, upwardly extending wall portions 130 form a recess 134 on base member top surface 90 which receives the reflective material 94 (see FIG. 7).

Referring back to FIG. 7, longitudinal side walls 86 are shown wherein each side wall 86 has a pair of opposed outwardly extending shoulder portions 136 positioned along opposed outer ends 138 along the longitudinal side wall bottom edge 128 and a pair of vertical side edge walls 140 extending upwardly from the outwardly projecting shoulder portions 136 towards a top edge 142 of the longitudinal side wall 86.

Figure 10:
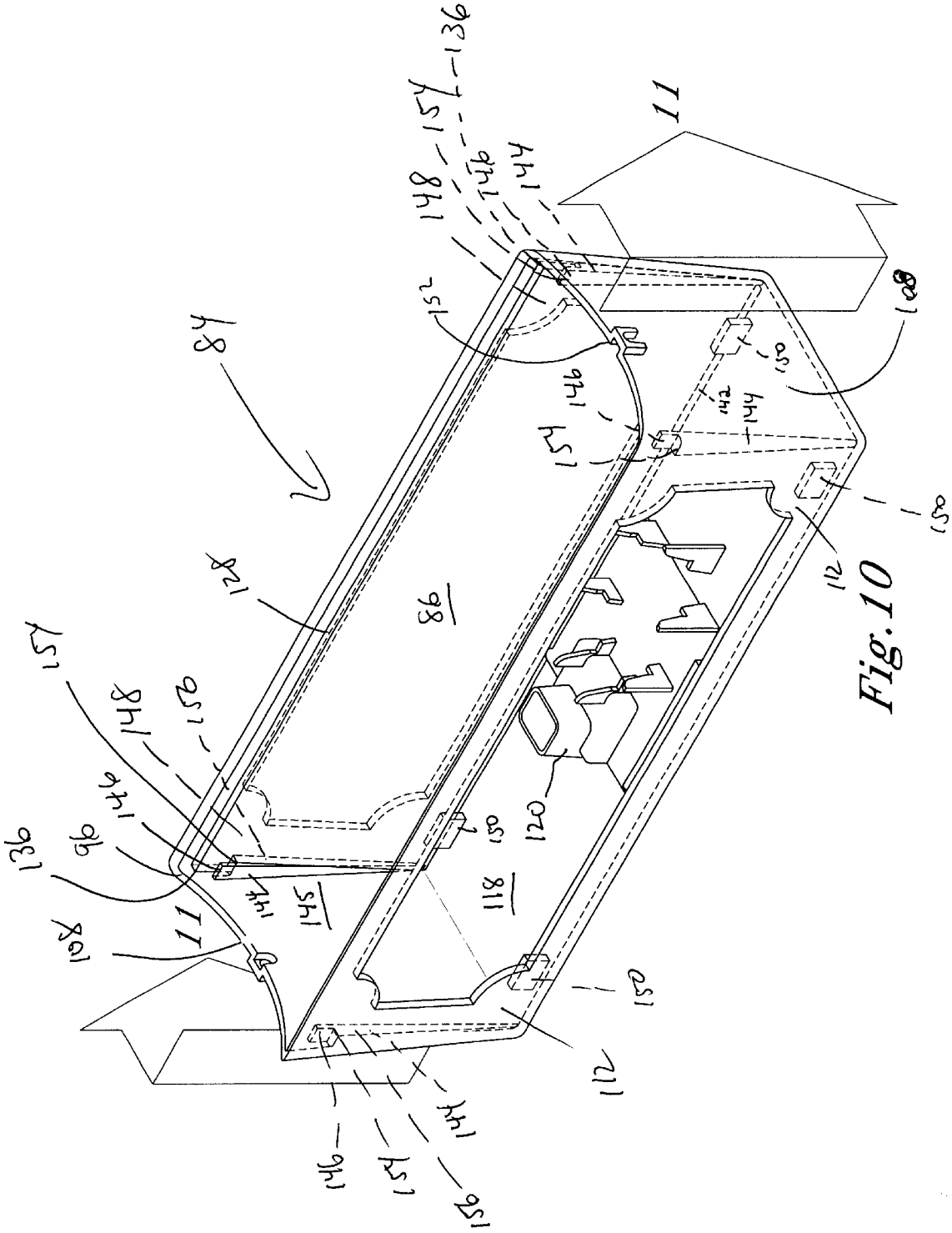
FIG. 10 is an inverted perspective view of a housing employed with the preferred embodiment of the present invention.

With reference now to FIG. 10, housing 84 is shown inverted with the base member removed. Mounted within housing 84 are a set of four downwardly extending and outwardly protruding guide rails 144 located proximal to four inner corners of housing 84, each extending from housing top wall inner surface 118 towards housing bottom side 96. Each guide rail 144 is attached to an opposed end wall inner surface 145 and a longitudinal side frame portion inner surface 148 of housing 84. Each guide rail 144 has a downwardly extending shoulder retention member 146 along a bottom end 154 thereof which is distal from the housing top wall inner surface 118. Each downwardly extending shoulder retention member 146 receives and retains, by friction, an opposed outwardly extending shoulder portion 136 of the respective longitudinal side wall 86 when it is inserted within housing 84. Further, each longitudinal side wall vertical side edge wall 140 (see FIG. 7) mates with a reciprocal outer edge 156 of the downwardly extending and outwardly protruding guide rail 144 when longitudinal side wall 86 is inserted within housing 84.

As also shown in FIG. 10, a set of four downwardly extending guide plates 150 are employed, attached along housing top wall inner surface 118, proximal to the housing inner corners, and spaced apart from a respective longitudinal side frame portion inner surface 148. Guide plates 150 work to from a series of friction fit locking tabs wherein two guide plates 150, positioned along a common longitudinal plane, work together to retain longitudinal side wall 86 when it is inserted within housing 84.

Figure 11:
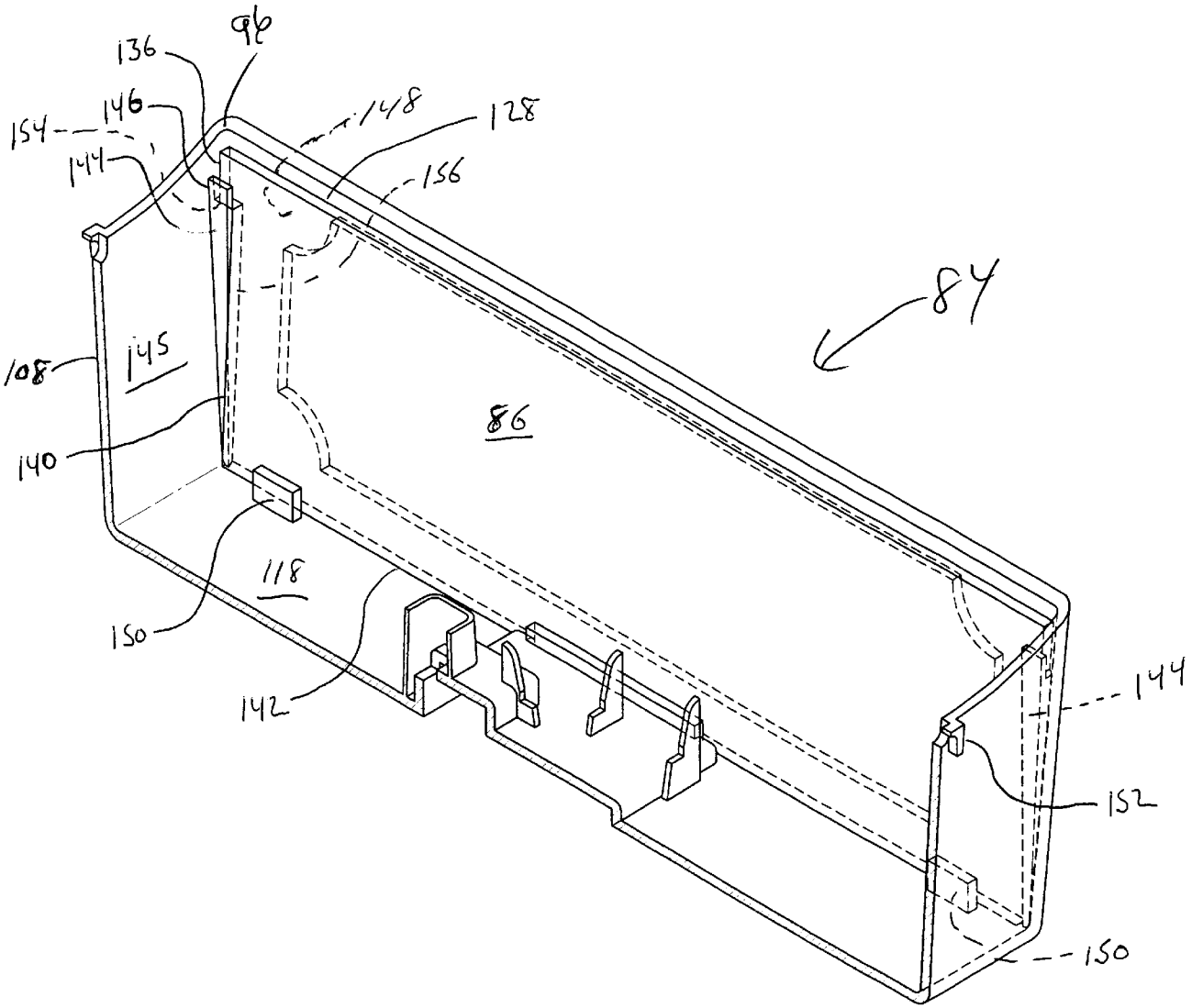
FIG. 11 is an inverted cross sectional perspective view along lines 11—11 of FIG. 10 of the housing employed with the preferred embodiment of the present invention.

As shown in FIGS. 10 and 11, downwardly extending shoulder retention members 146 and downwardly extending guide plates 150 work in concert to retain a longitudinal side wall 86 in place, by friction fit, at the top and bottom edges, 142 and 128 respectively, of longitudinal side wall 86, thereby pressing it outwardly and against housing longitudinal side frame portion inner surface 148.

As seen in FIG. 10, a pair of oppositely positioned apertures 152 are formed in housing opposed end walls 108 at housing bottom side 96. Apertures 152 receive a screw (not shown) and secure base member 88 to housing 84. It is important to note that base member 88 can snap into housing bottom side 96 and be adequately secured by friction, However, the use of the screws inserted through apertures 152 can ensure a tighter enclosure for housing 84.

Although not shown, a switching element is electrically coupled between battery 64 and light source 76 which is also electrically coupled to a photocell contained within the solar cell 60. The switching element is employed on circuit board 78 and operates light source 76 when the photocell determines that an ambient light level has either exceeded or fallen below a pre-defined threshold.

Equivalent elements can be substituted for the ones set forth above such that they perform the same function in the same way for achieving the same result.

Having thus described the invention what is claimed and desired to be secured by Letters Patent is:

1. An illuminating address indication device comprising:

a) a housing having a pair of longitudinal side walls, a pair of opposed end walls and a top wall, the longitudinal side walls, opposed end walls and top wall forming an inner channel and a bottom side for the housing, each longitudinal side wall having a bottom edge, at least one longitudinal side wall of the pair permitting light to shine there through, b) a base member positioned along the housing bottom side along the pair of longitudinal side wall bottom edges;

c) light means mounted within the housing inner channel for illuminating the address indication device;

d) at least one battery mounted within the housing inner channel and electrically coupled to the light means for supplying power thereto;

e) switching means mounted within the housing inner channel for operating a switch in response to a predetermined threshold of ambient light being exceeded, the switch electrically coupled between the battery and the light means; and f) indicia mounted on the housing at least one longitudinal side wall permitting light to shine there through.

2. The illuminating address indication device of claim 1 wherein the base member is convexed-shaped.

3. The illuminating address indication device of claim 1, wherein the at least one battery comprises a rechargeable battery.

4. The illuminating address indication device of claim 1, wherein the light means is at least one LED light mounted on a circuit board.

5. The illuminating address indication device of claim 1, further comprising a solar cell mounted to the housing for collecting sunlight radiation and energizing the at least one battery, the solar cell electrically coupled to the at least one battery.

6. The illuminating address indication device of claim 5, wherein the housing has a recessed portion formed within an outer top surface of the top wall for receiving and retaining the solar cell.

7. The illuminating address indication device of claim 1, further comprising the base member having a top and bottom surface.

8. The illuminating address indication device of claim 7, further comprising upwardly extending wall portions disposed proximal to and along outer side edges of the base member top surface.

9. The illuminating address indication device of claim 8, wherein the base member upwardly extending wall portions form a recess which receives and retains a reflective material mounted upon the base member top surface.

10. The illuminating address indication device of claim 1, wherein at least one of the longitudinal side walls of the pair is removable.

11. The illumination address indication device of claim 10, wherein the at least one removable longitudinal side wall includes a top edge, a bottom edge and a pair of outwardly projecting shoulder portions formed along opposed outer ends of the bottom edge thereby defining a pair of opposed vertical side edge walls extending upwardly from the outwardly projecting shoulder portions to the removable longitudinal side wall top edge.

12. The illumination address indication device of claim 11, further comprising a plurality of downwardly extending and outwardly protruding guide rails attached along inner surfaces of the housing opposed end walls and side wall frame portions, each guide rail having a downwardly extending shoulder retention member located along a bottom end of the guide rail, distal from an inner bottom surface of the housing top wall, for removably receiving and retaining an opposed outwardly extending shoulder portion of the at least one removable longitudinal side wall bottom edge, the housing removable longitudinal side wall vertical side edge wall mating with a reciprocal outer edge of the downwardly extending and outwardly protruding guide rails.

13. The illumination address indication device of claim 10, wherein the housing further includes a plurality of inner corners and a pair of opposed side wall frame portions having a pair of opposed end portions located proximal to the housing opposed end walls and connected by top and bottom longitudinal connecting members defining at least one opening formed in a side portion of the housing.

14. The illumination address indication device of claim 13, wherein the housing is integrally formed from at least the pair of opposed side wall frame portions, the pair of opposed end walls and the top wall.

15. The illumination address indication device of claim 13, further comprising a plurality of downwardly extending guide plates attached along an inner bottom surface of the housing top wall, proximal to the housing inner corners, and spaced apart from an inner surface of the opposed side wall frame portions thereby forming a series of friction fit locking tabs.

16. An illuminating address indication device comprising:

a) a housing having a pair of longitudinal side walls, a pair of opposed end walls and a top wall, the longitudinal side walls, opposed end walls and top wall forming an inner channel and a bottom side for the housing, each longitudinal side wall having a bottom edge, at least one longitudinal side wall permitting light to shine there through, b) a base member having a top and bottom surface and a pair of opposed outwardly extending side portions forming a shelf member along an outer edge of the opposed outwardly extending side portions, the base member bottom surface mounted to a top portion of a mailbox, a bottom edge of each of the pair of the housing longitudinal side walls resting upon one shelf member of each base member opposed outwardly extending side portion when the housing bottom side mates with the base member, c) light means mounted within the housing inner channel for illuminating the address indication device, d) at least one battery mounted within the housing inner channel and electrically coupled to the light means for supplying power thereto, e) switching means mounted within the housing inner channel for operating a switch in response to a predetermined threshold of ambient light being exceeded, the switch electrically coupled between the battery and the light means, f) a solar cell mounted on the housing for collecting sunlight radiation and energizing the at least one battery, and g) indicia mounted on at least one of the pair of the longitudinal side walls.

17. The illuminating address indication device of claim 16, wherein the housing top wall has a recessed portion formed therein for receiving and retaining the solar cell.

18. The illuminating address indication device of claim 16, wherein a sheet of reflective material is mounted upon the base member top surface.

19. The illuminating address indication device of claim 18, further comprising upwardly extending wall portions disposed proximal to and along outer side edges of the base member top surface, the upwardly extending wall portions forming a recess around the base member top surface in which the reflective material is disposed.

20. The illuminating address indication device of claim 16, wherein at least one of the pair of the longitudinal side walls is removable.

21. The illumination address indication device of claim 20, further comprising:

a) the at least one removable longitudinal side wall having a top edge, a bottom edge and a pair of outwardly projecting shoulder portions formed along opposed outer ends of the bottom edge thereby defining a pair of opposed vertical side edge walls extending upwardly from the outwardly projecting shoulder portions to the removable longitudinal side wall top edge;

b) a set of four inner corners located within the housing;

c) a pair of opposed side wall frame portions having a pair of opposed end portions located proximal to the housing opposed end walls and connected by top and bottom longitudinal connecting members; and d) a plurality of downwardly extending and outwardly protruding guide rails attached along inner surfaces of the housing opposed end walls and opposed side wall frame portions, each guide rail having a downwardly extending shoulder retention member located along a bottom end of the guide rail, distal from an inner bottom surface of the housing top wall, for removably receiving and retaining an opposed outwardly extending shoulder portion of the at least one removable longitudinal side wall bottom edge, the housing removable longitudinal side wall vertical side edge wall mating with a reciprocal outer edge of the downwardly extending and outwardly protruding guide rails.

22. The illumination address indication device of claim 21, further comprising a plurality of downwardly extending guide plates attached along an inner bottom surface of the housing top wall, proximal to the housing inner corners, and spaced apart from an inner surface of the opposed side wall frame portions thereby forming a series of friction fit locking tabs.

23. An illuminating address indication mailbox comprising:

a) a container having a flat bottom portion, a pair of upwardly extending side walls, a back wall, a front door, and a top wall, the container forming an inner compartment for receiving mail, the container supported by a post mounted to a ground surface;

b) a housing having a pair of longitudinal side walls, a pair of opposed end walls and a top wall, the longitudinal side walls, opposed end walls and top wall forming an inner channel, at least one of the pair of longitudinal side walls being translucent, the housing mounted upon the container top wall;

c) light means mounted within the housing inner channel for illuminating the address indication mailbox;

d) at least one battery mounted within the housing and electrically coupled to the light means for supplying power thereto;

e) switching means mounted within the housing for operating a switch in response to a pre-determined threshold of ambient light being exceeded, the switch electrically coupled between the battery and the light means, and f) indicia mounted on at least one of the pair of housing longitudinal side walls.

24. The illuminating address indication mailbox of claim 23, further comprising a solar cell mounted on the housing for collecting sunlight radiation and energizing the at least one battery.

25. The illuminating address indication mailbox of claim 23, wherein at least one of the pair of the longitudinal side walls is removable.

* * * * *